US010171923B2

(12) United States Patent
Shilton

(10) Patent No.: US 10,171,923 B2
(45) **Date of Patent: *Jan. 1, 2019**

(54) BINAURAL HEARING SYSTEM AND METHOD

(71) Applicant: CIRRUS LOGIC INTERNATIONAL SEMICONDUCTOR LIMITED, Edinburgh (GB)

(72) Inventor: Anthony John Shilton, Richmond (AU)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/841,034

(22) Filed: Dec. 13, 2017

(65) Prior Publication Data

US 2018/0103329 A1 Apr. 12, 2018

Related U.S. Application Data

(63) Continuation of application No. 14/433,025, filed as application No. PCT/AU2013/001142 on Oct. 4, 2013, now Pat. No. 9,906,874.

(Continued)

(51) Int. Cl.
*H04R 25/00* (2006.01)
*H04R 5/033* (2006.01)

(Continued)

(52) U.S. Cl.
CPC ..... *H04R 25/552* (2013.01); *H04R 5/033* (2013.01); *H04R 1/1083* (2013.01); *H04R 3/005* (2013.01);

(Continued)

(58) Field of Classification Search
CPC .... H04R 25/552; H04R 5/033; H04R 1/1083; H04R 3/005; H04R 5/027; H04R 25/407;

(Continued)

(56) References Cited

U.S. PATENT DOCUMENTS 5,479,522 A 12/1995 Lindemann et al.
7,571,015 B2 * 8/2009 Chan ..... G11B 19/022 700/94

(Continued)

FOREIGN PATENT DOCUMENTS

WO WO 2007/017809 A1 2/2007

OTHER PUBLICATIONS

International Search Report for International Application No. PCT/AU2013/001142, dated Nov. 15, 2013, 5pp.

(Continued)

*Primary Examiner* — Andrew L Sniezek
(74) *Attorney, Agent, or Firm* — Lewis Roca Rothgerber Christie LLP

(57) ABSTRACT

A system (202) for binaural signal processing. A first speaker (210) and a second speaker (220) are respectively mounted proximal to, and deliver respective first and second acoustic signals to, the left and right ears of a user. A first microphone (212) and a second microphone (222) are respectively mounted proximal to the left and right ears. A binaural processing device receives signals from the microphones and, based on the microphone signals, determines the first and second acoustic signals. The binaural processing device operates at a distance from both the left and right ears of the user. The speakers, microphones and the binaural processing device are connected by a signal network.

11 Claims, 2 Drawing Sheets

Related U.S. Application Data

(60) Provisional application No. 61/710,248, filed on Oct. 5, 2012.

(51) Int. Cl.

| | |
|---|---|
| *H04R 5/027* | (2006.01) |
| *H04R 5/04* | (2006.01) |
| *H04R 1/10* | (2006.01) |
| *H04R 3/00* | (2006.01) |

(52) U.S. Cl.
CPC ..... *H04R 5/027* (2013.01); *H04R 5/04* (2013.01); *H04R 25/407* (2013.01); *H04R 25/453* (2013.01); *H04R 25/558* (2013.01); *H04R 2201/107* (2013.01); *H04R 2205/041* (2013.01); *H04R 2410/05* (2013.01)

(58) Field of Classification Search
CPC ..... H04R 25/453; H04R 25/558; H04R 2201/107; H04R 2205/041; H04R 2410/05
See application file for complete search history.

(56) References Cited

U.S. PATENT DOCUMENTS

| | | | | |
|---|---|---|---|---|
| 9,571,918 | B2 | 2/2017 | Giannuzzi | |
| 9,906,874 | B2 * | 2/2018 | Shilton | H04R 25/552 |
| 2004/0116151 | A1 | 6/2004 | Bosch et al. | |
| 2009/0076636 | A1 | 3/2009 | Bradford et al. | |
| 2011/0188662 | A1 | 8/2011 | Jensen et al. | |
| 2012/0183164 | A1 | 7/2012 | Foo et al. | |
| 2012/0183165 | A1 | 7/2012 | Foo et al. | |
| 2012/0213393 | A1 | 8/2012 | Foo et al. | |
| 2012/0215519 | A1 | 8/2012 | Park et al. | |
| 2012/0215532 | A1 | 8/2012 | Foo et al. | |
| 2013/0197920 | A1 | 8/2013 | Lesso et al. | |
| 2013/0236040 | A1 | 9/2013 | Crawford et al. | |
| 2014/0086417 | A1 | 3/2014 | Hansen et al. | |

OTHER PUBLICATIONS

Written Opinion for International Application No. PCT/AU2013/001142, dated Nov. 15, 2013, 4pp.

* cited by examiner

BINAURAL HEARING SYSTEM AND METHOD

CROSS-REFERENCE TO RELATED APPLICATIONS

This application is a continuation application of U.S. patent application Ser. No. 14/433,025, filed Apr. 1, 2015, which is a National Stage of International Application No. PCT/AU2013/001142, filed Oct. 4, 2013, which claims the priority to and the benefit of U.S. Provisional Patent Application No. 61/710,248 filed Oct. 5, 2012 entitled "BINAURAL HEARING SYSTEM AND METHOD," the entire contents of which are hereby expressly incorporated herein by reference.

FIELD OF THE INVENTION

The present invention relates to the digital processing of signals from microphones or other such transducers, and in particular relates to a system and method for signal processing for a binaural hearing system such as binaural hearing aids.

BACKGROUND

Binaural hearing systems delivering two separate acoustic signals, one to each ear of a user, generally provide better performance than monaural systems in which a single acoustic signal is delivered to a single ear, in teams of sound clarity, perceived dynamic range, speech perception and a "natural" sound.

Binaural systems can achieve a stereo effect. Further, for users with hearing loss each acoustic signal produced by a binaural system can be uniquely customised to best meet the needs of the ear to which it is being delivered, as typically defined by an audiogram. Additionally, each acoustic signal produced by a binaural system can generally be set at a lower volume than is required for a monaural system, putting less stress on the user's hearing.

FIG. 1 shows a typical binaural system, comprising two hearing aids 102, 104, one on each ear of the user. Stereo hearing aid functionality is achieved by ear level microphones and speakers. In simple form the DSP processing at each ear is independent. For best performance binaural systems should not simply comprise two monaural devices operating independently for each ear. Rather, it is desirable for each acoustic signal produced by a binaural system for one ear to be created by processing which also takes into account factors affecting or derived from the other ear, such processing being referred to herein as "integrated" binaural processing. However, to effect such integrated binaural signal processing requires significantly greater complexity and for example requires substantially continuous collection of signal and environment parameters at both ears, for integrated processing by a single processor which can be mounted in either device, or one such processor in each device.

Devices having a speaker at each ear, but which do not gather microphone information at each ear, also suffer a number of disadvantages. For example, conventional telephony headsets can have speakers at each ear, a boom-mounted or wire-mounted microphone near the user's mouth, cheek, or larynx, and a wired or wireless connection from the headset to a controlling device which can be a mobile telephone, desktop computer, or desktop telephone base. The microphone signal can be analysed by the controlling device to implement a range of signal processing techniques such as noise reduction, however with the microphone distal from the ear such devices can not provide effective hearing aid performance as they provide a mono channel and give no directional cues. Moreover integrated binaural processing can not be effected with only a single microphone. Similarly, audio playback devices such as MP3 players and the like can deliver two separate acoustic signals to the respective ears of the user for example to provide a stereo effect, but these devices do not provide a microphone at or proximal to each ear in order that the acoustic signal for each ear can be produced in a manner which takes into account factors affecting or derived from that ear and from the other ear and thus do not provide integrated binaural signal processing.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first aspect the present invention provides a system for binaural signal processing, the system comprising:

- a first speaker and a second speaker respectively configured to be mounted proximal to, and to deliver respective first and second acoustic signals to, the left and right ears of a user;
- a first microphone and a second microphone respectively configured to be mounted proximal to the left and right ears of a user; and a binaural processing device for receiving signals from the first and second microphones and for defining the first and second acoustic signals based upon the signals from the first and second microphones, the binaural processing device being operable when distal from the left and right ears of the user;
- wherein the first and second speakers, the first and second microphones and the binaural processing device are connected by a signal network configured to pass signals from the first and second microphones to the binaural processing device and from the binaural processing device to the speakers.

According to a second aspect the present invention provides a method for binaural signal processing, the method comprising:

- obtaining a first microphone signal from a first microphone mounted proximal to a left ear of a user, and obtaining a second microphone signal from a second microphone mounted proximal to a right ear of a user;
- a binaural processing device receiving the first and second microphone signals via a signal network and, based upon the first and second microphone signals, producing first and second output signals, the binaural processing device being operable when distal from the left and right ears of the user; and a first speaker and a second speaker, respectively mounted proximal to the left and right ears of the user, respectively receiving the first and second output signals from the binaural processing device via the signal network and delivering respective first and second acoustic signals to the left and right ears of the user.

According to another aspect the present invention provides a computer program product comprising computer program code means to make a computer execute a procedure for binaural signal processing, the computer program product comprising computer program code means for carrying out the method of the second aspect.

A non-transitory computer readable medium for binaural signal processing, comprising instructions which, when executed by one or more processors, causes performance of the following:

obtaining a first microphone signal from a first microphone mounted proximal to a left ear of a user, and obtaining a second microphone signal from a second microphone mounted proximal to a right ear of a user;

a binaural processing device receiving the first and second microphone signals via a signal network and, based upon the first and second microphone signals, producing first and second output signals, the binaural processing device being operable when distal from the left and right ears of the user; and a first speaker and a second speaker, respectively mounted proximal to the left and right ears of the user, respectively receiving the first and second output signals from the binaural processing device via the signal network and delivering respective first and second acoustic signals to the left and right ears of the user.

In embodiments of the invention the binaural signal processing may be configured to implement a hearing aid. Additionally or alternatively, the binaural signal processing may be configured to implement an assisted listening device (ALD) or personal sound amplifier product (PSAP). Additionally or alternatively, the binaural signal processing may be configured to implement a binaural telephony headset, audio playback function, or audio recording function.

The signal network connecting the first and second speakers, the first and second microphones and the binaural processing device preferably comprises a single wire bus. Such embodiments may be particularly beneficial in allowing implementation of the present invention by use of already-common consumer headphone wires. For example, a smart phone executing a suitable app or application could connect to a suitable headset through an industry standard 3.5 mm jack and implement such embodiments of the present invention.

The first and second speakers, the first and second microphones and the binaural processing device are preferably chained together along the single wire bus to complete the signal network. The binaural processing device preferably operates as a network master and provides a master clock signal on the bus for clock retrieval by other devices on the bus. The signal network preferably supports multiple channels to permit multiple devices to be sending or receiving simultaneously, such as time-division multiplexed channels. Preferably, the clock signal and signal data are embedded into a single symbol stream on the bus.

In preferred embodiments the first and second speakers are positioned downstream of the bus master in the network chain, and the first and second microphones are positioned downstream of the first and second speakers in the network chain. In such embodiments, data slots used to send the first and second output signals from the binaural processing device to the first and second speakers will subsequently become available for use by the first and second microphones to send the first and second microphone signals to the binaural processing device. However, alternative chaining order may be provided in alternative embodiments.

The telephony headset may comprise an over-the-head cradle for supporting ear cups, over-the-ear moulds for mounting the speakers, or may comprise unsupported ear buds.

The binaural processing device may comprise a mobile telephone, smart phone, tablet computer, or e-reader, for example.

The first and second microphones, and the first and second speakers, are preferably mounted upon a headset. The headset may have a wired connection to the binaural processing device or may utilise a wireless connection. The connection between the headset and the binaural processing device is preferably low latency for improved system performance.

In some embodiments more than one microphone is provided at one or both ears.

The microphones may be positioned external to or internal to the ear canal.

In some embodiments, sound captured by the microphone at one ear is used exclusively to determine the acoustic signal to be delivered to that ear, to effectively implement two independent hearing aids, one at each ear. Alternatively, sound captured at both ears may be used to produce the acoustic signal to be delivered to each ear, to thereby binaurally integrate the two hearing aids.

BRIEF DESCRIPTION OF THE DRAWINGS

An example of the invention will now be described with reference to the accompanying drawings, in which.

DESCRIPTION OF THE PREFERRED EMBODIMENTS

Figure 1:
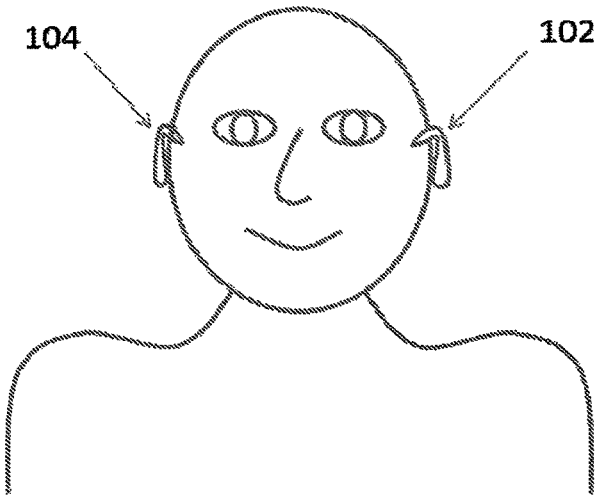
Figure 1 (PRIOR ART)
FIG. 1 shows a typical prior binaural system.
Figure 2:
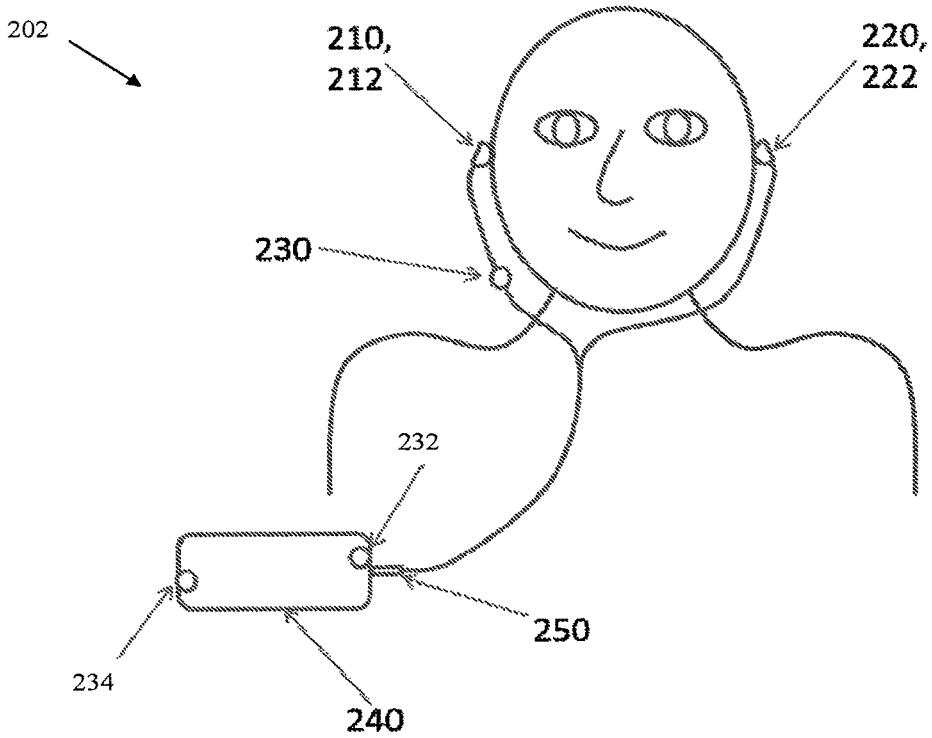
FIG. 2 illustrates a system for integrated binaural signal processing in accordance with one embodiment of the invention.
Figure 3:
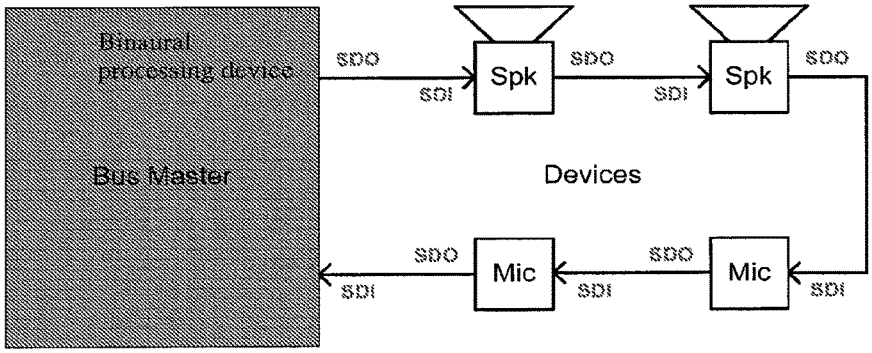
FIG. 3 illustrates the chained single wire signal network in the system of FIG. 2.

FIG. 2 illustrates a system for integrated binaural signal processing in accordance with one embodiment of the invention. A binaural processing device 202 is chained in a single wire signal network with two speakers 210, 220 and two microphones 212, 222. The speakers and microphones are arranged as a wired headset so as to position one speaker and one microphone proximal to a user's ear when in use. More microphones may also be provided (e.g. 230, 232, 234) for example to capture the user's voice or at other positions to capture additional signals. Additional microphones located on the earpieces may be located external to or internal to the ear canal. The microphones' signals are passed to the processor 240 via the signal network (FIG. 3). The standard 3.5 mm jack (250) and headset wire carries data from between 2 and 6 microphones (212, 222, 230, 232, 234 etc), along with power for the speakers and microphones as required, and an electrical ground reference.

The signal network bus is shown in FIG. 3. Low latency on the bus is important for total processing delay and for feedback cancellation.

Binaural processing is performed in the binaural processing device, which in this embodiment is a mobile handset. Alternative embodiments may utilise a tablet computer or e-reader for this function.

In this embodiment, the binaural processing is configured to effect binaural hearing aid processing. That is, signals captured from the vicinity of the user's ears are processed and amplified in accordance with a user-specific program and then delivered via the binaural speakers 210, 220, giving stereo effects and directional cues. Moreover, the hearing aid processing performed in the mobile handset is configurable, and in this embodiment is under the control of apps running on the processor 240 of the mobile device. The apps are arranged to implement the user-specific program and to receive user input via the mobile device to allow the program to be updated when required.

Appropriate amplification and/or processing is also applied to music playback and telephony provided by the processor 240 of the mobile device, in accordance with the program executed by the app.

Figure 4:
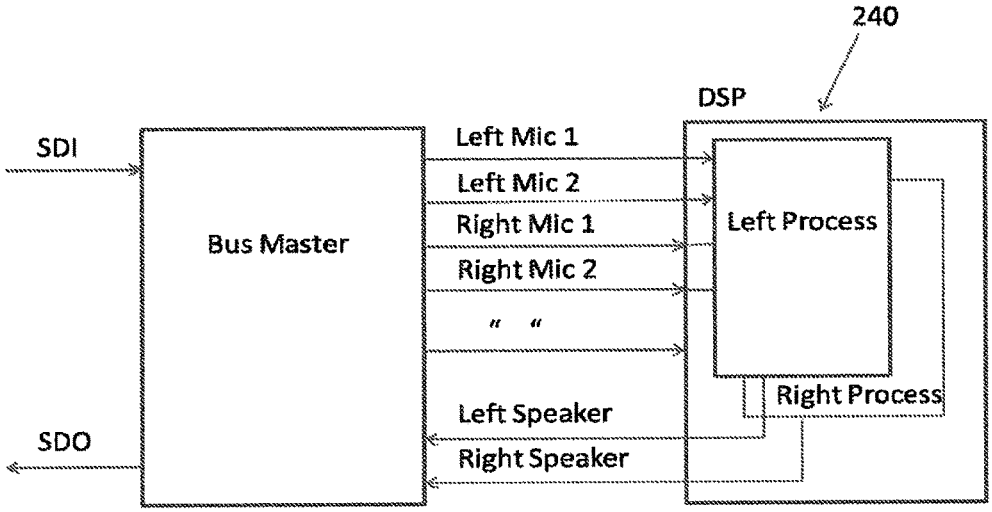
FIG. 4 illustrates the DSP processing within the smart phone.

As shown in FIG. 4, audio signal processing is performed in phone DSP 240. DSP 240 can implement standard hearing aid processing functions for both ears, such as directional microphones (with 2 mics per ear), feedback cancellation, noise reduction and compression. Hearing aid processing can, selectively, be applied during telephone calls and audio playback from the smart phone.

In this embodiment, a second mode can be provided by the device, whereby the mobile device itself carries at least one microphone 234, and the user can hold the mobile device close to a sound source of interest, for example by the user holding the mobile device out towards a person with whom they are speaking. In such embodiments the signal from the mobile device microphone 234 is processed by the binaural processing device and delivered to the user in a binaural manner.

In this embodiment, a third mode is also provided. In this third mode an external microphone (not shown), such as the microphone on another mobile device or an accessory microphone, is used and delivers an external microphone signal to the binaural processing device as part of the binaural processing to be performed.

A fourth mode of operation is to provide ambient noise cancellation via speakers 210, 220, based on detected noise signals obtained at each ear by mics 212, 222. Location of the mics 212, 222 at ear level is particularly advantageous for ambient noise cancellation.

Shifting the audio processing to a smart phone also permits a sophisticated user interface to be presented to the user, as opposed to simple toggle switches and the like which are all that can be typically provided on ear-mounted devices.

The second through fourth modes of operation can be entered into voluntarily, by the user inputting commands into the mobile device. Preferably, signal delay is kept to a minimum for feedback cancellation and to avoid negative occlusion effects.

The present embodiment of the invention uses a single wire chained bus and pulse length modulation scheme in order to interface the headset mounted microphones 212, 222 and speakers 210, 220, and the hearing aid processor 240. Due to the chained configuration, data must be recovered by each device and then re-modulated onto the bus by the same device. This requires one symbol period to achieve and therefore introduces bus latency of one symbol period per device on the bus. Data consuming devices (speakers 210, 220) should therefore desirably be first on the bus and data generating devices (microphones 212, 222) last on the bus. A wireless signal network may be suitable in alternative embodiments.

Notably, sound is captured binaurally at ear level and then processed in the mobile device processor 240. This is key to permit hearing aid performance, rather than low performance if distal microphones are used. Additionally, this enables in some embodiments the application of suitable algorithms that combine information from both ears to enhance the signal processing and/or deliver binaural integration.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A system for binaural signal processing, the system comprising:

a first speaker and a second speaker respectively configured to be mounted proximal to, and to deliver respective first and second acoustic signals to, the left and right ears of a user;

a first microphone and a second microphone respectively configured to be mounted proximal to the left and right ears of a user; and a binaural processing device for receiving respective first and second acoustic signals from each of the first and second microphones and for modifying each of the first and second acoustic signals to produce the modified first and second acoustic signals, wherein sound captured at both ears is used to modify the first acoustic signal to produce the modified first signal and sound captured at both ears is used to modify the second acoustic signal to produce the modified second signal, and wherein the binaural processing device is operable when distal from the left and right ears of the user;

wherein the first and second speakers, the first and second microphones and the binaural processing device are connected by a signal network configured to pass signals from the first and second microphones to the binaural processing device and from the binaural processing device to the speakers, wherein the signal network comprises a single wire chained bus loop having a chained configuration in which data from upstream on the single wire chained bus loop is recovered by each of the first and second speakers and the first and second microphones and re-modulated downstream onto the single wire chained bus loop, and wherein the first and second speakers are positioned downstream of the binaural processing device on the single wire chained bus loop, and the first and second microphones are positioned downstream of the first and second speakers on the single wire chained bus loop.

2. The system of claim 1, configured to implement a hearing aid.

3. The system of claim 1, configured to implement an assisted listening device (ALD) or personal sound amplifier product (PSAP).

4. The system of claim 1 wherein the single wire chained bus loop is connected to the binaural processing device by a 3.5 mm jack.

5. The system of claim 1 wherein the binaural processing device comprises one of: a mobile telephone, smart phone, tablet computer, and e-reader.

6. The system of claim 1 wherein at least one of the first microphone and the second microphone comprises two microphones.

7. A system for binaural signal processing according to claim 1 included in a telephone headset.

8. A system for binaural signal processing according to claim 1 included in an audio playback device.

9. A system for binaural signal processing according to claim 1 included in an audio recording device.

10. A method for binaural signal processing, the method comprising:

obtaining a first microphone signal from a first microphone mounted proximal to a left ear of a user, and obtaining a second microphone signal from a second microphone mounted proximal to a right ear of a user;

a binaural processing device receiving each of the first and second microphone signals via a signal network and modifying the first and second microphone signals to produce first and second acoustic output signals, wherein sound captured at both ears is used to modify the first microphone signal to produce the first acoustic output signal and the sound captured at both ears is used to modify the second microphone signal to produce the second acoustic output signal, and wherein the binaural processing device is operable when distal from the left and right ears of the user; and a first speaker and a second speaker, respectively mounted proximal to the left and right ears of the user, respectively receiving the first and second output signals from the binaural processing device via the signal network and delivering respective first and second acoustic output signals to the left and right ears of the user, wherein the signal network comprises a single wire chained bus loop having a chained configuration in which data from upstream on the single wire chained bus loop is recovered by each of the first and second speakers and the first and second microphones and re-modulated downstream onto the single wire chained bus loop, and wherein the first and second speakers are positioned downstream of the binaural processing device on the single wire chained bus loop, and the first and second microphones are positioned downstream of the first and second speakers on the single wire chained bus loop.

11. A non-transitory computer readable medium for binaural signal processing, comprising instructions which, when executed by one or more processors, causes performance of the following:

obtaining a first microphone signal from a first microphone mounted proximal to a left ear of a user, and obtaining a second microphone signal from a second microphone mounted proximal to a right ear of a user;

a binaural processing device receiving each of the first and second microphone signals via a signal network and modifying the first and second microphone signals to produce first and second acoustic output signals, wherein sound captured at both ears is used to modify the first microphone signal to produce the first acoustic output signal and the sound captured at both ears is used to modify the second microphone signal to produce the second acoustic output signal, and wherein the binaural processing device is operable when distal from the left and right ears of the user; and a first speaker and a second speaker, respectively mounted proximal to the left and right ears of the user, respectively receiving the first and second output signals from the binaural processing device via the signal network and delivering respective first and second acoustic output signals to the left and right ears of the user, wherein the signal network comprises a single wire chained bus loop having a chained configuration in which data from upstream on the single wire chained bus loop is recovered by each of the first and second speakers and the first and second microphones and re-modulated downstream onto the single wire chained bus loop, and wherein the first and second speakers are positioned downstream of the binaural processing device on the single wire chained bus loop, and the first and second microphones are positioned downstream of the first and second speakers on the single wire chained bus loop.

* * * * *